United States Patent [19]

Allen

[11] 4,312,601

[45] Jan. 26, 1982

[54] FASCINES

[75] Inventor: John M. Allen, Christchurch, England

[73] Assignee: The Secretary of State for Defence in Her Britannic Majesty's Government of the United Kingdom of Great Britain and Northern Ireland, London, England

[21] Appl. No.: 122,934

[22] Filed: Feb. 20, 1980

[30] Foreign Application Priority Data

Feb. 26, 1980 [GB] United Kingdom ..... 06700/79

[51] Int. Cl.[3] ..... E01C 9/08; E02B 3/12

[52] U.S. Cl. ..... 404/35; 14/1; 404/71; 405/15; 405/19

[58] Field of Search ..... 404/35, 46, 71; 14/1; 405/15, 16, 17, 19

[56] References Cited

U.S. PATENT DOCUMENTS

| | | | |
|---|---|---|---|
| 303,137 | 8/1884 | Elmer | 405/17 |
| 547,024 | 10/1895 | Neale | 405/17 |
| 1,166,050 | 12/1915 | Johnson | 405/19 |
| 1,629,315 | 5/1927 | Scott | 405/17 X |
| 1,691,848 | 11/1928 | Johnson | 405/19 |

FOREIGN PATENT DOCUMENTS

| | | | |
|---|---|---|---|
| 9773 | of 1843 | United Kingdom | 404/46 |
| 1210066 | 10/1970 | United Kingdom . | |
| 1439201 | 6/1976 | United Kingdom | 405/19 |
| 1519581 | 8/1978 | United Kingdom . | |

OTHER PUBLICATIONS

Columbus Vehicle Mat Co. brochure, "10 Examples of the Use of the Columbus Mat".

*Primary Examiner*—Rodney H. Bonck
*Attorney, Agent, or Firm*—Pollock, Vande Sande and Priddy

[57] ABSTRACT

A fascine capable of conforming to the contours of a supporting surface, comprises a core of loose cylindrical pipes disposed within a surrounding sleeve of similar pipes transversely and continuously inter-connected by flexible ties. Binding straps attached to the sleeve are reeved so as to cause axial pleating of the sleeve when tensioned, thereby to bind the core into rigid cylindrical form. The fascine is transported in bound condition and the binding straps slackened on deployment.

8 Claims, 6 Drawing Figures

FASCINES

Figure 1:
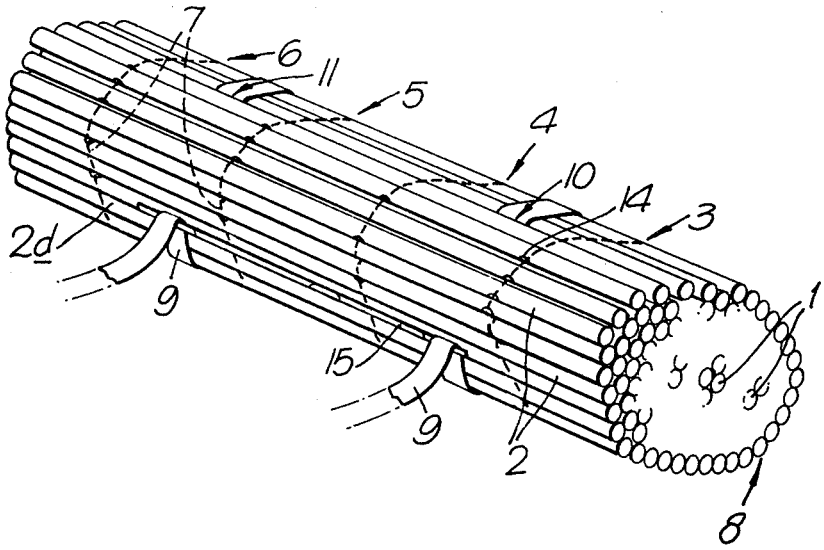

This invention relates to fascines and in particular to a fascine capable of conforming to the contours of a ditch or other ground discontinuity.

It is well known to fill a ditch with fascines comprising bound cylindrical bundles of sticks, rods or pipes in order to reduce the discontinuity sufficiently to allow passage of a tracked vehicle. Such fascines are not suitable for the passage of a wheeled vehicle as the remaining surface discontinuities are too great. Of course, the smaller the fascine and the greater the number used to fill a given volume, the smaller the remaining discontinuities will be, but deployment and recovery of the fascines then becomes too unmanageable and time consuming.

It is also known to lay fascine mats of flexibly interconnected parallel tubes across the top of a ditch filled in this manner in order to reduce discontinuities still further and to give increased stability, but again deployment and recovery problems are increased. Such mats are commercially available from the Columbus Vehicle Mat Co., S-15024 Ronninge 1, Sweden, and employ plastic tubes which are interconnected by flexible ties threaded transversely through the tubes.

The present invention seeks to provide a rapidly deployed and recovered fascine which will conform to the contours of a discontinuity so as to present a continuous upper surface suitable for the passage of wheeled as well as tracked vehicles.

In accordance with the present invention, a fascine includes:

- a core comprising a multiplicity of cylindrical core members freely disposed in use in axially parallel relationship,
- a sleeve disposed in use circumjacent the core, comprising a multiplicity of axially parallel cylindrical sleeve members transversely and continuously interconnectable by at least two axially spaced flexible tie means, and an adjustable binding means attachable to the sleeve for tightening and loosening the sleeve around the core.

In a preferred arrangement of the invention, the core members and the sleeve members are all of circular cross-section having equal external diameter and all of equal length, the length being selected to accommodate the width of the widest vehicle to be supported. Preferably they are all open-ended pipes of a plastics material or of a lightweight metal.

Each flexible tie means conveniently comprises a length of cable, rope, webbing or chain threaded sequentially through transverse perforations provided in each sleeve member and joined end-to-end to form a complete loop. The two ends of the length may alternatively overlap and pass through one or more same sleeve members in opposing directions before the loop is joined. The transverse perforations in the sleeve members may additionally be fitted with grommets to prevent chafe.

The adjustable binding means preferably comprises one or more straps adjustably engaged with some of the sleeve members so as to cause axial pleating of the sleeve when the straps are tensioned, thereby to tighten the sleeve around the core.

Figure 2:
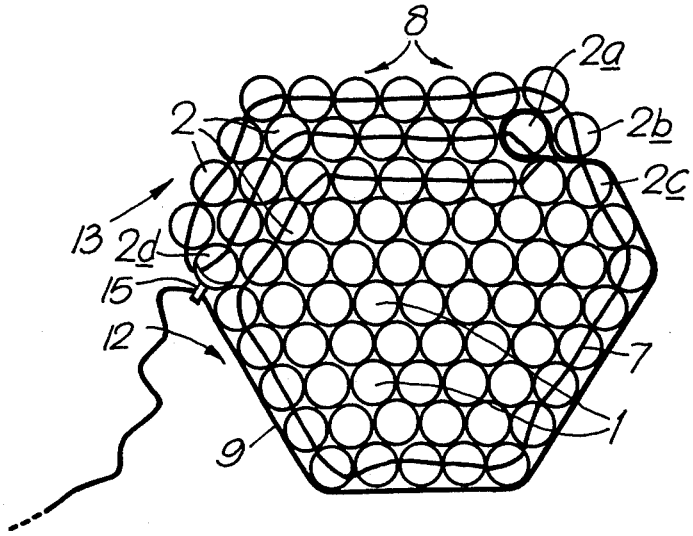
Figure 3:
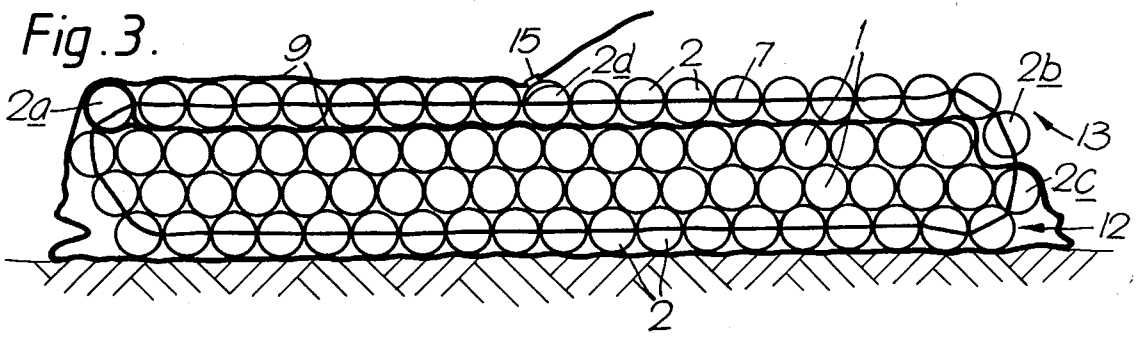
Figure 4:
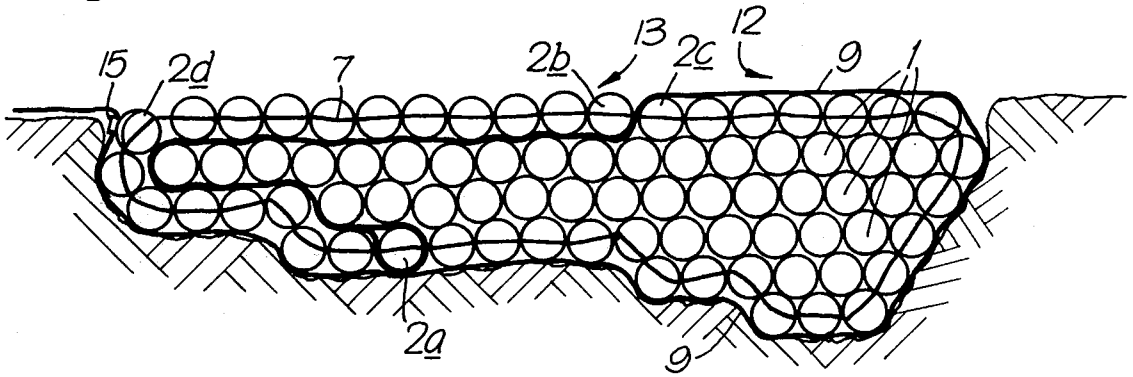
Figure 5:
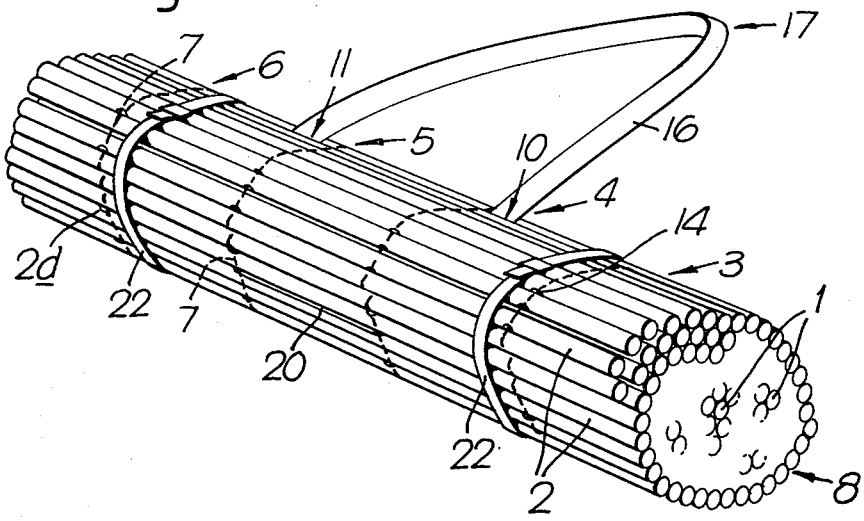
Figure 6:
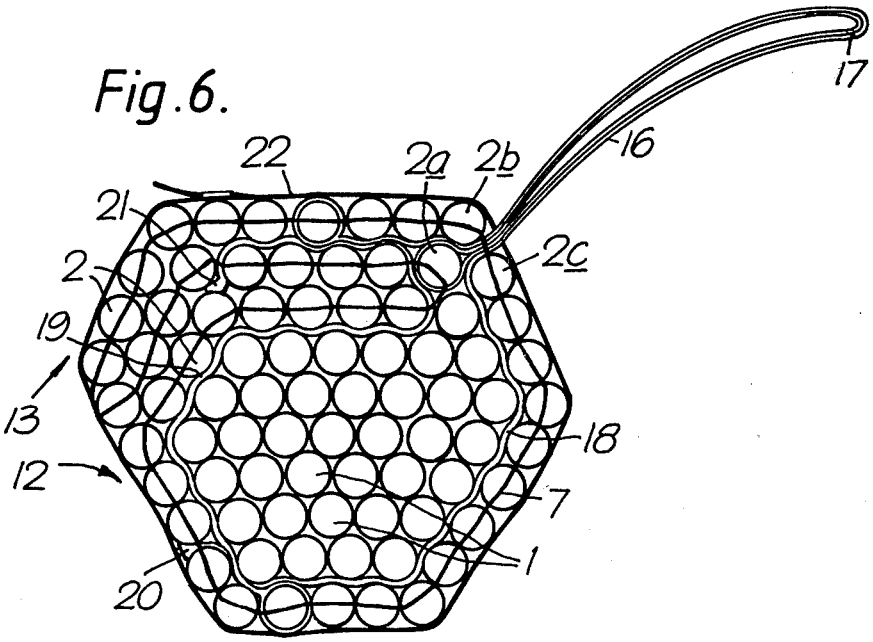

An embodiment of the invention will now be described by way of example only, with reference to the accompanying drawings of which FIG. 1 is a general view of a fascine in bound condition, FIG. 2 is an end view of the fascine illustrated in FIG. 1, FIG. 3 is an end view of the same fascine resting in unbound condition upon a flat surface, FIG. 4 is an end view of the same fascine lying in unbound condition in a ditch, and FIGS. 5 and 6 are a general view and an end view respectively of a similar fascine in bound condition having an alternative binding means.

The fascine illustrated in FIGS. 1 and 2 has an inner multiplicity of core members 1 and an outer multiplicity of sleeve members 2 all of which members consist of equal lengths of high density polyethylene pipe of 220 mm diameter and approximately 11 mm wall thickness. Standard water pipe is convenient for the purpose but any standard aluminum or polypropylene piping would be equally suitable.

All the sleeve members 2 have diametrically opposed perforations 14 in four transverse planes 3, 4, 5 and 6 (FIG. 1) and four steel cable loops 7 comprising the flexible tie means are threaded through the perforations in each of the four planes respectively, thereby forming the sleeve members 2 into a continuous sleeve 8.

Two binding straps 9 are attached to one sleeve member 2*a* at axial locations 10 and 11 respectively (FIG. 1), which straps then pass transversely through the interior of the sleeve 8 both emerging between the two sleeve members 2*b* and 2*c* (FIG. 2) to divide the sleeve 8 into a core binding bight 12 and a loose bight 13.

The emergent straps 9 continue around the outside of the binding bight 12 to finally pass through a releasable clasp means 15 attached to one sleeve member 21 located substantially midway around the loose bight 13. The straps 9 are of sufficient length to remain threaded through the clasp means 15 when the sleeve 8 is at its full expansion.

The fascine is bound into the configuration of FIGS. 1 and 2 by drawing the straps 9 through the clasp means 15, whereupon the binding bight 12 tightens around the core, compacting it into a rigid cylinder of roughly hexagonal cross-section, and the loose bight 13 is folded securely around the outer periphery of the binding bight 12. In this condition the fascine retains its integrity at any attitude and can be readily transported.

If the clasp means 15 is released to slacken the straps 9 while the fascine is resting on a flat surface, the rigid cylindrical form collapses and the freed core members 1 roll and slide laterally until constrained by the whole sleeve 8 to conform to the flattened cylindrical form illustrated in FIG. 3. Similarly if the rigidly bound fascine is dropped into a ditch before the clasp means 15 is released, the fascine will adopt the contours of the ditch as shown in FIG. 4. The fascine is readily re-compacted to rigid form for recovery after use simply by retightening the straps 9.

This embodiment is suitable for deployment from a standard fascine launcher and may be arranged so that the clasp means 15 is automatically released as the fascine is cast from the launcher.

An alternative arrangement of the adjustable binding means is illustrated in FIGS. 5 and 6, the fascine being identical in all other respects to the fascine described with reference to FIGS. 1 to 4. In this arrangement the two ends of a single binding strap 16 are attached to the sleeve member 2*a* at the locations 10 and 11 respectively, the binding strap 16 being threaded transversely through the interior of the sleeve 8 from the location 10, to emerge from the sleeve between the two sleeve members 2*b* and 2*c*, thereafter passing axially over the two cable loops 7 in the planes 4 and 5 respectively, thus forming a pick-up loop 17 before re-entering the sleeve 8 between the sleeve members 2*b* and 2*c* to join finally with the sleeve member 2*a* at the locaton 11.

The length of the binding strap 16 is just sufficient to allow full expansion of the loose bight 13 so that in the expanded condition the pick-up loop 17 nestles between the sleeve members 2*b* and 2*c* and is thus protected in use from over-passing vehicles.

Two further binding straps 18 and 19, identically arranged as the binding strap 16 and having pick-up loops 20 and 21 respectively, are provided at equally spaced intervals around the sleeve 8, thereby to ensure that one of the three pick-up loops 17, 20 or 21 will always be accessible from the top of the fascine whatever its deployed disposition may be.

The fascine is drawn into rigid form by lifting it via one of the pick-up loops, 17 as drawn, thus tightening the binding bight 12 around the core 2. The loose bight 13 folds loosely over onto the periphery of the binding bight 12 in this condition and two external securing straps 22 are then fastened around the whole fascine while the pick-up loop is still under tension. The securing straps 22 may conveniently be attached to the fascine launcher (not shown) so as also to hold the fascine in place on the launcher for transportation.

The fascine can be made in standard sizes assembled from preselected numbers of sleeve members 2 and core members 1 and can be used singly or in multiples to fill any particular ditch. Alternatively, where the approximate size of a ditch to be crossed is known in advance, the fascine may be made roughly to measure, the total number of sleeve members being calculated to fit the approximate periphery of the ditch section and the number of core members being calculated to fill the remaining section area.

An exact fit is not essential as a satisfactory crossing can be made even when the ditch is partially underfilled or overfilled. When the opposing banks of the ditch are at different levels the fascine can be deployed with an appropriately inclined upper surface.

The embodiment described has been found capable of supporting vehicles weighing up to 60 tons without serious impairment. Some slight crushing of the uppermost sleeve members may occur at the upper end of the loading range but these can be easily replaced in the field. If required, reinforcement may be provided by the insertion of two short liners (not shown) of steel or a plastics material into each sleeve member 2, which liners are axially retained by adjacent pairs of the cable loops 7, the liners being situated between the transverse planes 3 and 4 and the transverse planes 5 and 6 respectively, the location of these planes being selected to ensure that the liners lie directly beneath the vehicle wheels or tracks.

Pipe fascines in accordance with the present invention can be used with advantage in a watercourse as their open construction does not impeded water flow. They consequently provide a useful alternative to temporary bridge structures and can also be employed as false work for building permanent bridge structures.

The invention may be further deployed as a ramp permitting a wheeled or tracked vehicle to ascend or descend steps.

The choice of an inert plastics material for the present fascine eases storage problems in comparison with the widely used wooden fascines of the prior art, as no protection from weather is necessary.

I claim:

1. A fascine including a core comprising a multiplicity of cylindrical core members freely disposed in use in axially parallel relationship, a sleeve disposed in use circumjacent the core, comprising a multiplicity of axially parallel cylindrical sleeve members transversely and continuously interconnected by at least two axially spaced flexible tie means disposed as continuous loops, and an adjustable binding means attached to the sleeve for axially pleating the sleeve around the core.

2. A fascine as claimed in claim 1 wherein said core members and said sleeve members are all of circular cross-section having equal external diameter and are all of equal length.

3. A fascine as claimed in claim 1 wherein said core members and said sleeve members are open ended.

4. A fascine as claimed in claim 1 wherein said sleeve members each have transverse perforations through which said flexible tie means are threaded.

5. A fascine as claimed in claim 1 wherein said adjustable binding means includes at least one strap attached in use to one of said sleeve members, each of which straps traverses the interior of the sleeve and is emergent between two other sleeve members, thereby to divide the sleeve into two axially parallel bights one being a core binding bight and the other being a loose bight.

6. A fascine as claimed in claim 5 wherein said loose bight is provided with clasp means for securing each emergent strap to said loose bight after partially girdling said core binding bight.

7. A fascine as claimed in claim 5 wherein said emergent straps are conjoined in pairs so as to provide axially parallel pick-up loops.

8. A fascine as claimed in claim 7 wherein said adjustable binding means further includes at least one external securing strap.

* * * * *